US005710397A

United States Patent [19]

Liao

[11] Patent Number: 5,710,397

[45] Date of Patent: Jan. 20, 1998

[54] SWITCH ACTUATOR FOR MEMBRANE SWITCH

[75] Inventor: Pin-Chien Liao, Taoyuan, Taiwan

[73] Assignee: Acer Peripherals, Inc., Taoyuan, Taiwan

[21] Appl. No.: 511,132

[22] Filed: Aug. 4, 1995

[51] Int. Cl.[6] ..... H01H 3/12; H01H 13/50

[52] U.S. Cl. ..... 200/5 A; 200/517; 200/345

[58] Field of Search ..... 200/5 A, 600, 200/512–517, 341–345

[56] References Cited

U.S. PATENT DOCUMENTS

| | | | |
|---|---|---|---|
| 4,527,030 | 7/1985 | Oelsch | 200/5 A X |
| 4,641,004 | 2/1987 | Keprda | 200/341 |
| 4,684,767 | 8/1987 | Phalen | 200/5 A |
| 4,736,076 | 4/1988 | Mochizuki et al. | 200/600 X |
| 4,927,990 | 5/1990 | Aoki et al. | 200/517 |
| 5,010,219 | 4/1991 | Kato | 200/517 |
| 5,115,106 | 5/1992 | Weiland et al. | 200/517 |
| 5,283,408 | 2/1994 | Chen | 200/345 |
| 5,298,706 | 3/1994 | English | 200/5 A X |
| 5,306,886 | 4/1994 | Yamada | 200/5 A X |

*Primary Examiner*—J. R. Scott

*Attorney, Agent, or Firm*—Fish & Richardson P.C.

[57] ABSTRACT

The switch actuator provided comprises a rubber dome, a housing, a keytop and a plunger. The rubber dome is seated on the switch and is selectively deformed to actuate the switch. The housing receives the rubber dome therein and has an upper opening defining an edge of the opening and has an inner surface. The plunger moves reciprocally within the housing and is guided by the edge during the reciprocal movement of the keytop. The keytop, which has a bottom surface, moves reciprocally and vertically together with the plunger to selectively deform the rubber dome to actuate the switch as the result of the operation of the user. The invention is characterized in that a slant surface is formed on the inner surface of the housing to retain the bifurcated hook end of the plunger to reduce the noise generated during movement of the plunger.

13 Claims, 4 Drawing Sheets

SWITCH ACTUATOR FOR MEMBRANE SWITCH

TECHNICAL FIELD OF THE INVENTION

The invention relates to an actuator for a push button switch, and in particular, to a switch actuator with a reduced noise during operation.

BACKGROUND OF THE INVENTION

The push button switch is widely used in many industrial applications, e.g. keyboard input device.

As shown in FIG. 1, a typical key switch includes a membrane switch 11, a rubber dome 13, a housing 15, a plunger 17 and a keytop 19. The rubber dome 13 is seated on the membrane switch 11 and is selectively deformed to actuate the membrane switch 11. The housing 15, which has an inner surface, receives the rubber dome 13 and has an upper opening defining an edge of the opening. The keytop 19, which has a bottom surface, moves reciprocally and vertically together with the plunger to selectively deform the rubber dome 13 to actuate the membrane switch 11 as the result of the operation of the user. The plunger 17 moves reciprocally within the housing 15 and is guided by the edge of the opening during the reciprocal movement of the keytop 19. The element 14 is the support plate for the push button switch. The plunger hooks 171 are formed in the plunger 17 to limit the upward movement of the plunger and the keytop by the interaction of the hook end 12 with the edge of the opening of the housing 15 while bouncing upward. Typically, an actuator includes the rubber dome, housing, plunger and the keytop.

As the user removes the applied force from the keytop 19 permitting the plunger 17 to bounce upward, an undesired noise will be annoying due to the impact between the point 121 substantially away from the hook end 12 of the plunger hook 171 and the edge 121*a* of the opening.

SUMMARY OF THE INVENTION

To the drawback of the aforesaid conventional art, the instant invention substantially reduces the annoying noise.

The switch actuator provided comprises a rubber dome, a housing, a keytop and a plunger.

The rubber dome is selectively deformed to actuate the membrane switch. The rubber dome is seated on the membrane switch.

The housing receives the rubber dome and has an upper opening defining an edge of the opening and has an inner surface.

The plunger moves reciprocally within the housing and is guided by the housing edge during the reciprocal movement of the keytop.

The keytop, which has a bottom surface, moves reciprocally and vertically together with plunger to selectively deform the rubber dome to actuate the membrane switch as the result of the operation of the user.

The invention is characterized in that a slant or curved surface is formed on the inner surface of the housing walls to retain the hook end of the plunger during an upward movement of the plunger in order to reduce the noise generated thereof.

The details and other advantages of the invention will be apparent from more detailed description of the invention together with the following appended drawings.

BRIEF DESCRIPTIONS OF THE DRAWINGS

FIG. 1(A), 1(B) shows the push button switch in accordance with the conventional art.

FIG. 2(A), 2(B), 2(C) shows one preferred embodiment of the invention.

FIG. 3(A), 3(B), 3(C) shows second preferred embodiment of the invention.

DETAILED DESCRIPTIONS OF THE INVENTION

Figure 2A:
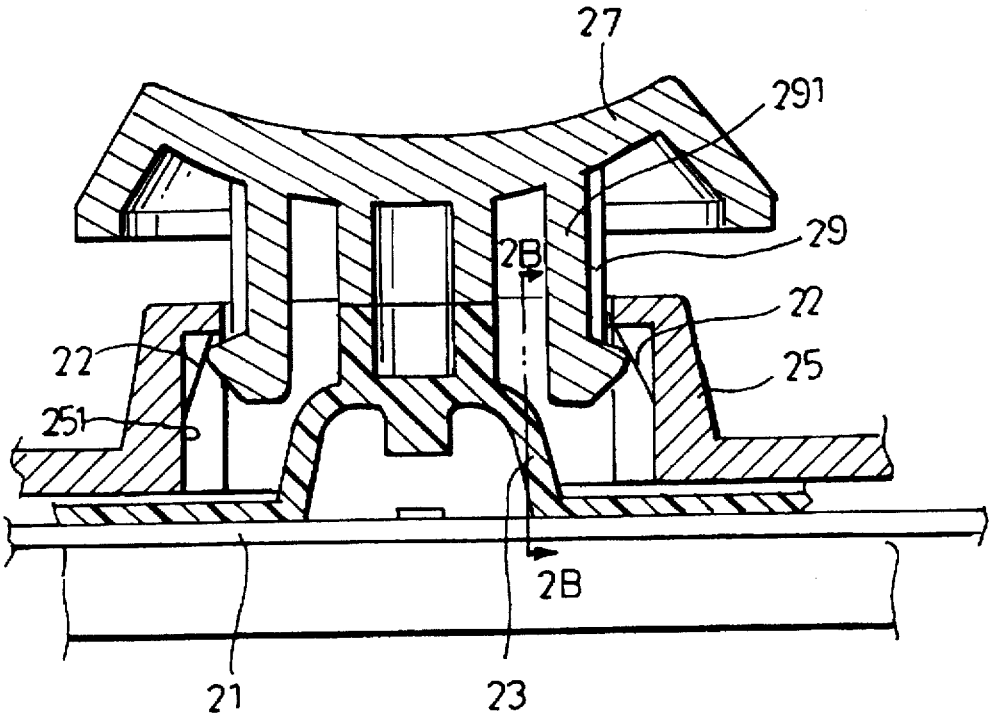
Figure 2B:
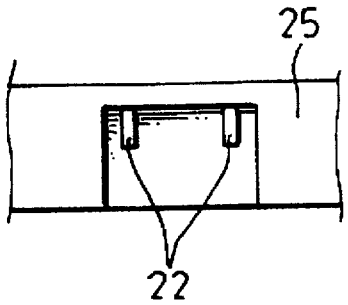

Referring to FIG. 2, The key switch provided comprises a membrane switch 21, a rubber dome 23, a housing 25, a keytop 27 and a plunger 29.

The rubber dome 23 is selectively deformed, in response to the applied force from the user, to actuate the membrane switch 21. The rubber dome 23 is seated on the membrane switch 21.

The housing 25 receives the rubber dome 23 and has an upper opening defining an edge of the opening and has an inner surface 251.

The plunger 29 moves reciprocally within the housing 25 and is guided by the edge of the opening during the reciprocal movement of the keytop 27.

The keytop 27, which has a bottom surface 271, moves reciprocally and vertically together with the plunger 29 to selectively deform the rubber dome 23 to actuate the membrane switch 21 as the result of the operation of the user.

Figure 1A:
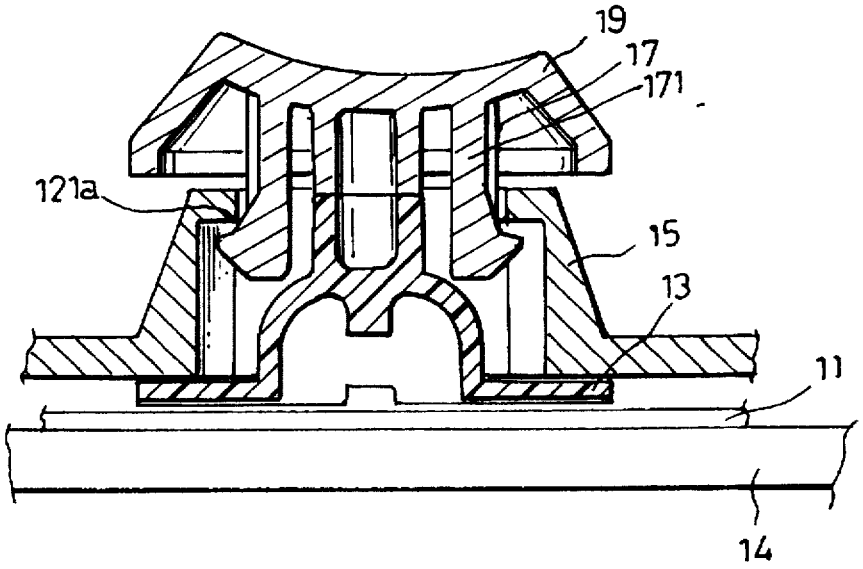
FIG. 1A PRIOR ART
Figure 1B:
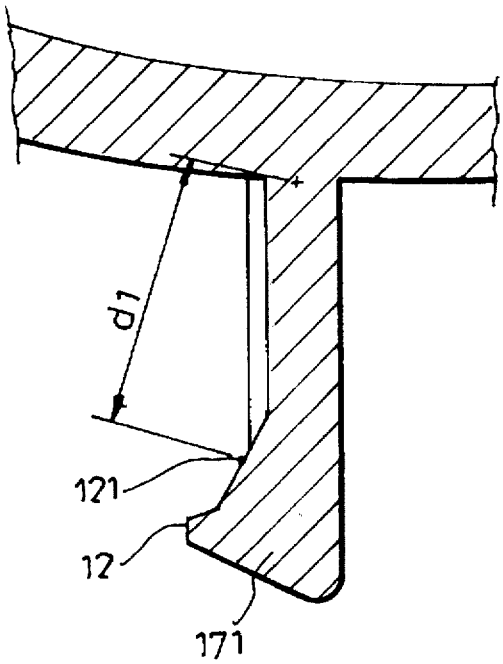
FIG. 1B PRIOR ART
Figure 2C:
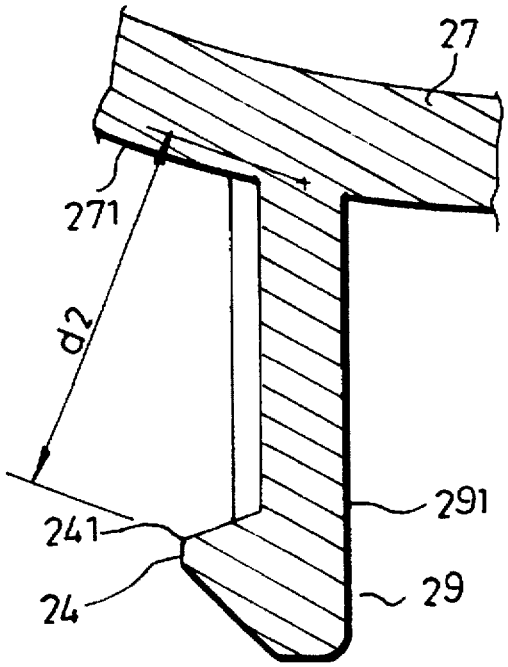

The invention is characterized in that a slant surface 22 or a curved surface 22*a* is formed on the inner surface 251 of the housing 25 to retain the end 24 of the plunger hook 291 during an upward movement of the plunger 29 in order to reduce the noise generated thereof. As shown in FIG. 2(A) and 2(C), the impact paint 241 is away from the bottom surface 271 of the keytop 27 by the distance d2 which is obviously greater than d1 in FIG. 1(B). From the theory of the Applied Mechanics, it is well known the deflection capacity of point 241 is greater than the point 121 while other conditions being the same. Substantial amount of the impact force from the point 241 of the plunger hook 291 is diverted to a horizontal direction due to the slant angle of the slant surface 22 or the curved surface 22*a* provided. After the impact, the snap friction with damping effect between the point 241 and the slant surface 22 or curved surface 22*a* increases as plunger moves upward. It is this damping effect which reduces the impact force, knock noise or knocking vibration resulted during bouncing back of the plunger. Due to the aforesaid reasons, the instant invention has a lower noise or knocking vibration generated during the upward movement of the plunger 29.

Figure 3A:
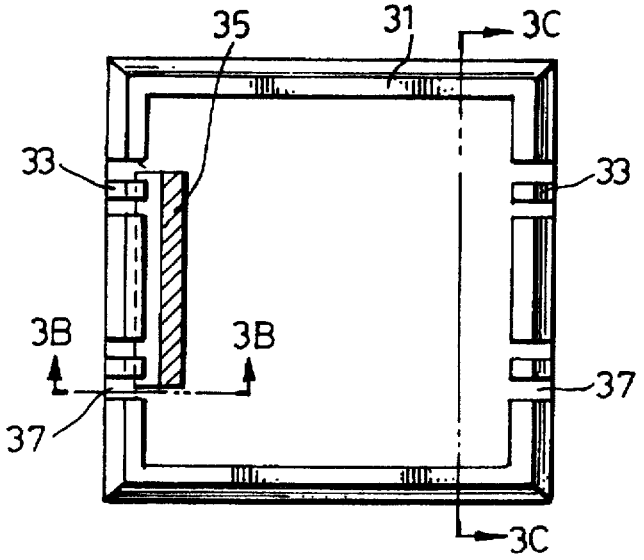
Figure 3B:
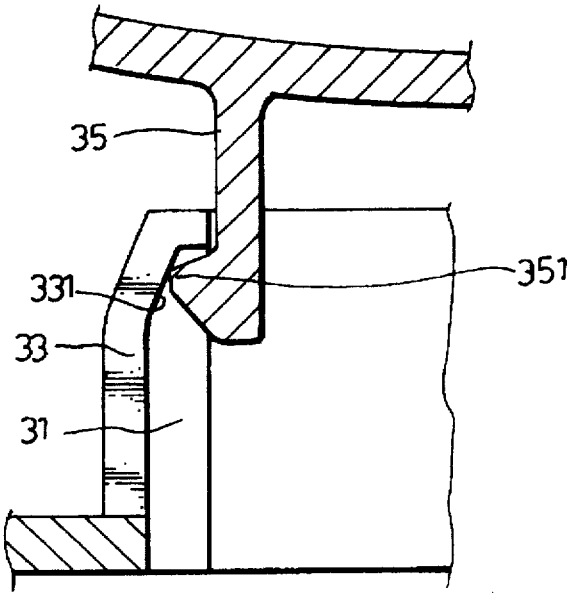
Figure 3C:
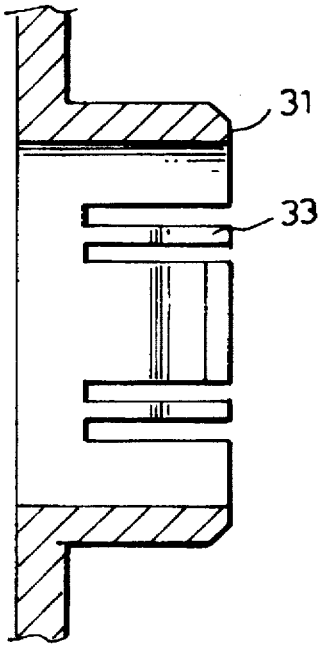

Referring to FIG. 3(A) of the second embodiment of the invention, the housing 31 of the invention provides a peninsula-type retainer 33 which retains the end 351 of the plunger hook 35 when the plunger hook 35 bounces upward. From the section view of FIG. 3(B), it is readily shown that the end 351 hits the inner slant surface or curved surface of the retainer 33 such that the impact force is diverted to side direction and the most of the kinetic energy is lost due to the damping effect. Therefore, the noise generated thereof is smaller than that of the conventional approach.

The reason for the retainer 33 being a peninsula-type is that while the base of the retainer is integral with the housing 31, the inwardly slant portion of the retainer 33 is isolated from the major top portion of the housing 31 via two adjacent grooves, as shown in FIG. 3(A). The purpose of the grooves is to prohibit any vibration or noise created at the time of the interaction of the retainer 33 with the hook end 351 from being transmitted to the housing 31 and to keyboard module. Therefore, the noise generated is a substantial minimum.

Figure 4:
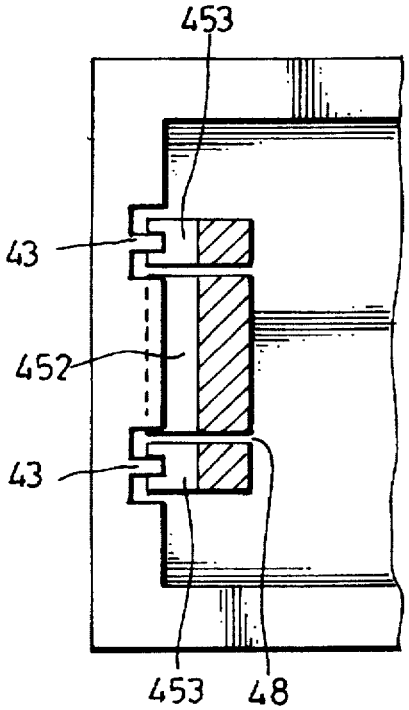
FIG. 4 shows plunger hooks of peninsula type are provided in accordance with the invention.

In another embodiment of FIG. 4, the grooves 48 are provided on the part of the hook 45, instead of on the housing, to form the peninsula-type hook end 453 as the damping device for the impact noise generated.

The detailed description of the invention recited above is only for illustrative, rather than limiting, purpose. Therefore, not only the above preferred embodiment of the invention, but the equivalence or modification thereof are intended scope of the protection of the invention which is defined by the following claims.

Figure 5:
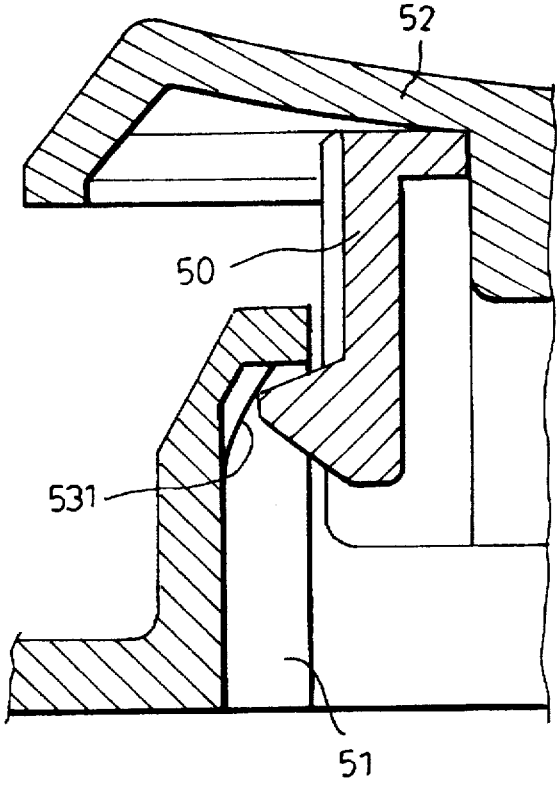
FIG. 5 shows the push button switch of which the plunger is a separate item from the keytop.

For instance, it is well known that the plunger used in the switch actuator may be integral with the key top as shown in aforesaid figures or a separate item 50 from the key top 52 as shown in FIG. 5. To both approaches, the spirit and embodiments of the invention are applicable.

Furthermore, the actuator provided in the invention may also be applied to switch other than the membrane switch disclosed and described in the aforesaid embodiment.

I claim:

1. An actuator for a switch, comprising:

a rubber dome having an electrically conductive bridge surface, the rubber dome being seated on the switch for selectively actuating the switch;

a housing for receiving the rubber dome, the housing having an upper opening defining an edge of the opening and having an inner surface, the inner surface having portions of a horizontal surface and a slanted surface;

a plunger moving reciprocally within the housing and being guided by the edge of the opening during the reciprocal movement, the plunger having a hook end retained by the slanted surface of the inner surface of the housing in response to an upward movement of the plunger, thereby reducing the noise generated by the movement of the plunger, wherein the horizontal surface of the inner surface prevents detachment of the plunger from within the housing;

a keytop having a bottom surface, the keytop moving reciprocally and vertically together with the plunger to selectively deform the rubber dome and actuate the switch as a result of the operation of a user.

2. An actuator for a switch, comprising:

a rubber dome having an electrically conductive bridge surface, the rubber dome being seated on the switch for selectively actuating the switch;

a housing for receiving the rubber dome, the housing having a top portion and an upper opening defining an edge of the opening and having an inwardly slanted peninsula-type retainer provided on the top portion, the inwardly slanted peninsula-type retainer having an inner surface, the inner surface having portions of a horizontal surface and a slanted surface;

a plunger moving reciprocally within the housing and being guided by the edge of the opening during the reciprocal movement, the plunger having a hook end which is retained by the slanted surface of the inner surface of the inwardly slanted peninsula-type retainer in response to an upward movement of the plunger, thereby reducing the noise generated by the movement of the plunger, wherein the horizontal surface of the inner surface of the inwardly slanted peninsula-type retainer prevents detachment of the plunger from within the housing;

a keytop having a bottom surface, the keytop moving reciprocally and vertically together with the plunger to selectively deform the rubber dome to and actuate the switch as a result of the operation of a user.

3. The actuator as recited in claim 1, wherein the plunger is integral with the bottom surface of the keytop.

4. The actuator as recited in claim 2, wherein the plunger is integral with the bottom surface of the keytop.

5. The actuator as recited in claim 1, wherein the switch is a membrane switch.

6. The actuator as recited in claim 1, wherein the slant surface is a curved surface.

7. The actuator as recited in claim 2, wherein the slant surface is a curved surface.

8. An actuator for a switch, comprising:

a rubber dome having an electrically conductive bridge surface, the rubber dome being seated on the switch for selectively actuating the switch;

a housing for receiving the rubber dome, the housing having an upper opening defining an edge of the opening and having an inner surface, the inner surface having portions of a horizontal surface and an inwardly slanted surface;

a keytop having a bottom surface;

a plunger moving reciprocally within the housing and being guided by the edge of the opening during the reciprocal movement of the keytop, the plunger having a bifurcated hook end retained by the inwardly slanted surface of the inner surface of the housing in response to an upward movement of the plunger, thereby reducing the noise generated by the movement of the plunger, wherein the horizontal surface of the inner surface prevents detachment of the plunger from within the housing, the keytop moving reciprocally and vertically together with the plunger to selectively deform the rubber dome to actuate the switch as a result of the operation of a user.

9. An actuator for a switch, comprising:

a rubber dome having an electrically conductive bridge surface, the rubber dome being seated on the switch for selectively actuating the switch;

a housing for receiving the rubber dome, the housing having a top portion and an upper opening defining an edge of the opening and having an inwardly slanted peninsula-type retainer provided on the top portion, the inwardly slanted peninsula-type retainer having an inner surface, the inner surface having portions of a horizontal surface and a slanted surface;

a keytop having a bottom surface;

a plunger moving reciprocally within the housing and being guided by the edge of the opening during the reciprocal movement of the keytop, the plunger having a bifurcated hook end which is retained by the slanted surface of the inner surface of the inwardly slanted peninsula-type retainer in response to an upward movement of the plunger thereby reducing the noise generated by the movement of the plunger, wherein the horizontal surface of the inner surface of the inwardly slanted peninsula-type retainer prevents detachment of the plunger from within the housing, the keytop moving reciprocally and vertically together with the plunger to selectively deform the rubber dome to actuate the switch as a result of the operation of a user.

10. The actuator of claim 1 wherein the slanted surface is slanted inwardly from a lower end of the housing toward the upper opening of the housing, the hook end of the plunger being retained in continuous contact with the inwardly slanting surface as the rubber dome is being deformed.

11. The actuator of claim 2 wherein the hook end of the plunger is retained in continuous contact with the inwardly slanting surface as the rubber dome is being deformed.

12. The actuator of claim 8 wherein the hook end of the plunger is retained in continuous contact with the inwardly slanting surface as the rubber dome is being deformed.

13. The actuator of claim 9 wherein the hook end of the plunger is retained in continuous contact with the inwardly slanting surface as the rubber dome is being deformed.

* * * * *